US005182532A

United States Patent [19]

Klein

[11] Patent Number: 5,182,532

[45] Date of Patent: Jan. 26, 1993

[54] THERMAL-MAGNETIC TRIP UNIT

[75] Inventor: Keith W. Klein, Simsbury, Conn.

[73] Assignee: General Electric Company, New York, N.Y.

[21] Appl. No.: 841,180

[22] Filed: Feb. 25, 1992

[51] Int. Cl.[5] ..... H01H 75/12

[52] U.S. Cl. ..... 335/35; 335/167; 335/37; 335/23

[58] Field of Search ..... 335/23-25, 335/35-38, 45, 167-176

[56] References Cited

U.S. PATENT DOCUMENTS

| | | | |
|---|---|---|---|
| 3,156,796 | 11/1964 | Vogelsberg | 335/35 |
| 3,178,535 | 4/1965 | Gelzheiser et al. | 335/35 |
| 3,179,767 | 4/1965 | Middendorf | 200/116 |
| 3,278,707 | 10/1966 | Klein | 200/116 |
| 3,278,708 | 10/1966 | Casey et al. | 200/116 |
| 3,292,118 | 12/1966 | Pastene | 335/35 |
| 3,555,468 | 1/1971 | Myers | 335/35 |
| 3,566,318 | 2/1971 | Gelzheiser et al. | 335/35 |
| 3,950,715 | 4/1976 | Bagauni et al. | 335/38 |
| 4,081,852 | 3/1978 | Coley et al. | 335/45 |
| 4,513,268 | 4/1985 | Seymour et al. | 335/35 |
| 4,951,015 | 8/1990 | Shea et al. | 335/38 |

*Primary Examiner*—Lincoln Donovan
*Attorney, Agent, or Firm*—Richard A. Menelly

[57] ABSTRACT

A molded case thermal-magnetic circuit breaker having improved low current magnetic trip response interfaces an intermediate armature between the circuit breaker latching element and the magnet assembly within the circuit breaker thermal-magnetic trip system. The intermediate armature optimizes the magnetic trip forces applied to both the intermediate armature and the latching element to enhance low current magnetic trip response.

23 Claims, 7 Drawing Sheets

THERMAL-MAGNETIC TRIP UNIT

BACKGROUND OF THE INVENTION

Thermal-magnetic trip units used within residential and commercial molded case circuit breakers are generally limited by geometric considerations from providing low current magnetic trip response. U.S. Pat. No. 4,513,268 describes a residential type molded case circuit breaker incorporating a thermal-magnetic trip unit in accordance with the prior art. U.S. Pat. No. 4,951,015 describes a movable core that is designed to move into the gap existing between the core and armature of a magnetic trip unit to reduce the primary air gap and increase the magnetic flux. The movable core effectively allows the circuit breaker to trip at lower current levels. U.S. Pat. Nos. 3,179,767, 3,278,707 and 3,278,708 each describe the use of an additional turn of wire around the magnet used within the thermal-magnetic trip unit to increase the magnetic forces on the armature at low currents.

Additionally, U.S. patent application Ser. No. 841,182 entitled "Thermal-Magnetic Trip Unit with Low Current Response" now U.S, Pat. No. 5,173,674 describes a molded case circuit breaker trip unit employing a pivotally-arranged magnet that moves unit employing a pivotally-arranged magnet that moves toward the armature to reduce the magnetic gap separation distance.

The aforementioned thermal-magnetic trip assemblies are found to add to the materials and assembly costs of the residential circuit breakers employing thermal-magnetic trip units.

The addition of supplemental magnets and armatures correspondingly increases the manufacturing tolerances that must be carefully controlled to insure compliance with the relevant industry standards.

One purpose of the invention accordingly is to provide a thermal-magnetic trip unit providing low current magnetic trip response with automatic tolerance compensation at relatively low cost.

SUMMARY OF THE INVENTION

The invention comprises a thermal-magnetic trip unit of the type employing a stationary magnet structure and a movable latching element that moves toward the magnet in proportion to overload circuit currents. The bimetal element is positioned between the magnet and the latching element and is electrically connected in series with the circuit current. Magnetic forces induced within the magnet attract the movable latching element to interrupt the circuit current upon occurrence of an overload current of predetermined value. An intermediate armature interposed between the latching element and magnet substantially increases the magnetic forces applied to the latching element to enhance low current magnetic trip response.

DESCRIPTION OF THE PREFERRED EMBODIMENT

Figure 1:
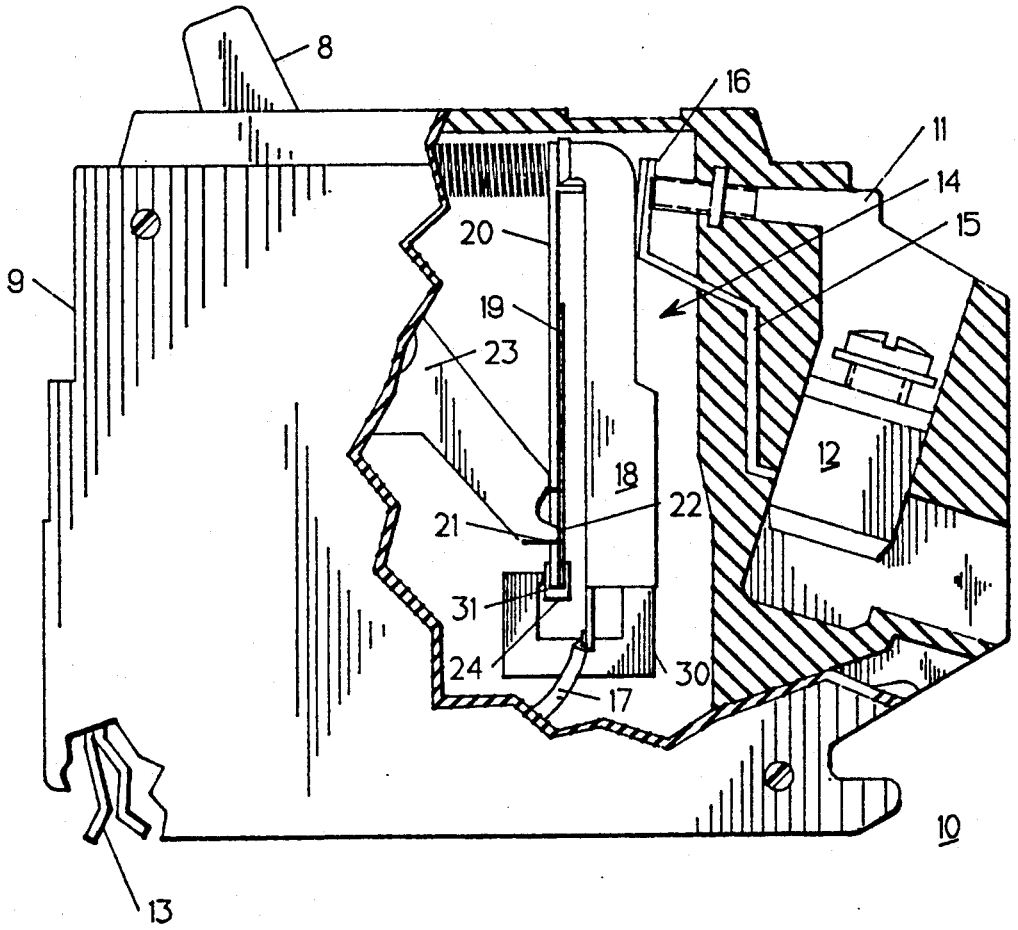
FIG. 1 is a front view of a residential circuit breaker with the cover partially removed to depict the thermal-magnetic trip unit according to the invention.

A residential molded case circuit breaker 10 is shown in FIG. 1 and consists of a molded plastic case 11 to which a molded plastic cover 9 is fixedly attached. The circuit breaker is turned between its ON and OFF conditions by means of the circuit breaker operating handle 8. As described in the aforementioned U.S. Pat. No. 4,513,268, external electrical connection is made by means of the terminal lug 12 at the load end of the breaker and with the line terminal 13 extending from the bottom part of the line end of the circuit breaker. The occurrence of an overcurrent condition within an associated electrical distribution circuit is determined within the thermal-magnetic trip unit 14 which connects with the load terminal by means of the load strap 15. The load strap connects with the bimetal element 16 which in turn connects with the movable contact arm 28 (FIG. 3) by means of the braided conductor 17. The electric current through the bimetal induces an electromagnetic force within the magnet 18 that partially encompasses the bimetal at the bottom part thereof. As further described within the aforementioned U.S. Pat. No. 4, 513,268, a latching element 20 supports the hook 22 on the end of the releasable element 23 within the latching slot 21 formed in the bottom part of the latching element. An intermediate armature 19 is positioned between the latching element 20 and the magnet 18 and is connected with the latching element 20 by means of a flexible U-shaped spring 24. An electrically insulating strap can be inserted between the magnet and the intermediate armature to prevent arcing under high current short circuit conditions. The bottom 31 of the latching element 20 connects with the bottom of the magnet 18 by means of the flat U-shaped stop 30.

Figure 2:
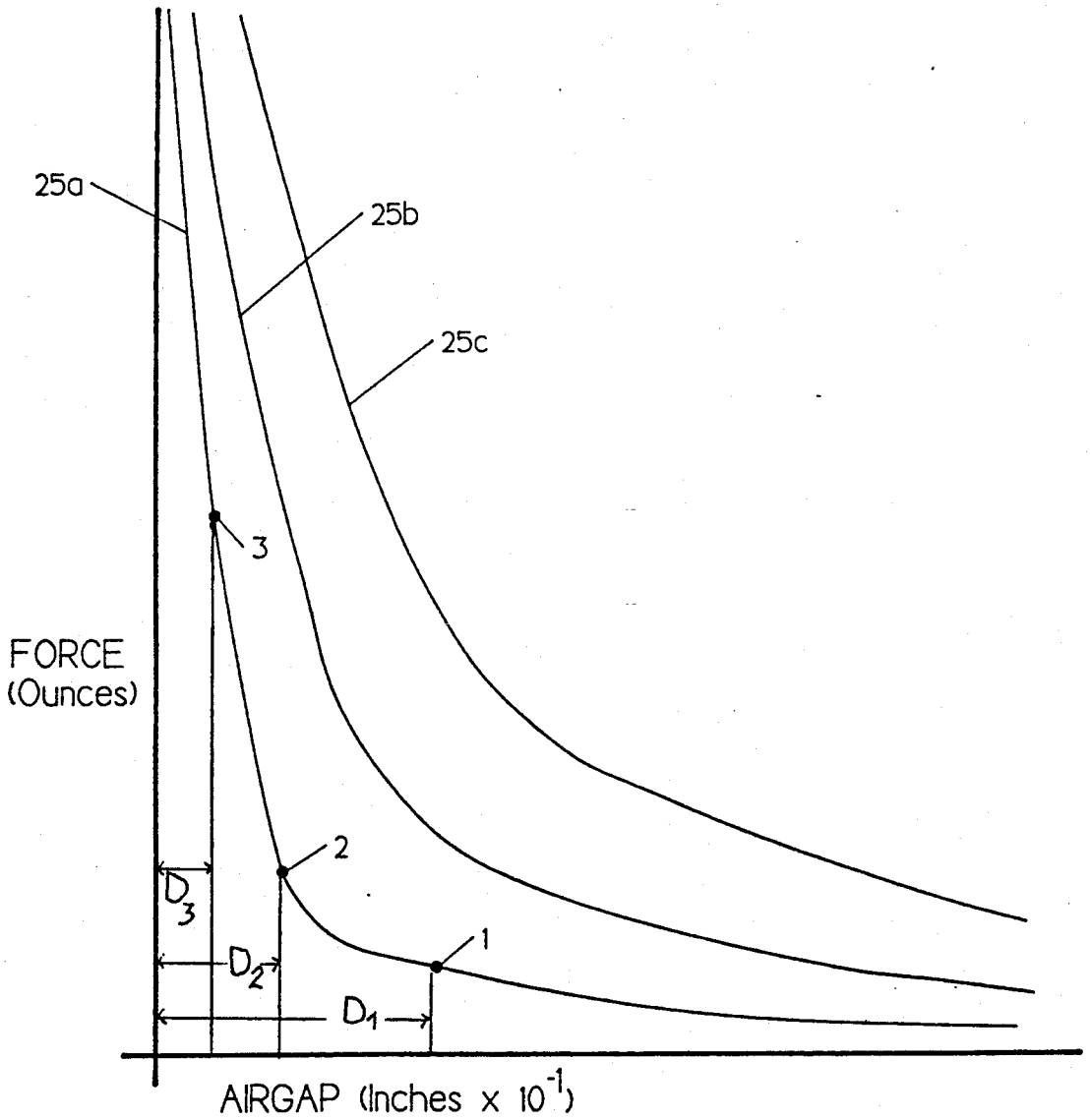
FIG. 2 is a graphic representation of the magnetic force within the thermal-magnetic trip unit of FIG. 1 as a function of air gap and circuit current.

The function of the intermediate armature is best seen by referring now to the graphic representations of increasing circuit current 25*a*, 25*b* and 25*c*, depicted in FIG. 2. It is noted at points (1–3) that the magnetic force exerted upon the intermediate armature decreases exponentially as a function of the air gap separation distance $D_1D_3$ defined between the intermediate armature and the magnet. Referring back to FIG. 1, the trip force is defined as the amount of magnetic force required to displace the latching element 20 away from the hook 22 to articulate the circuit breaker operating mechanism and separate the circuit breaker contacts. Since the trip force is independent of air gap separation and current and the magnetic force exerted upon the latching element varies directly with increasing current and decreasing air gap, it is concluded that in order to generate sufficient magnetic trip force for the lowest value of current, the air gap should be made as small as possible.

Figure 3:
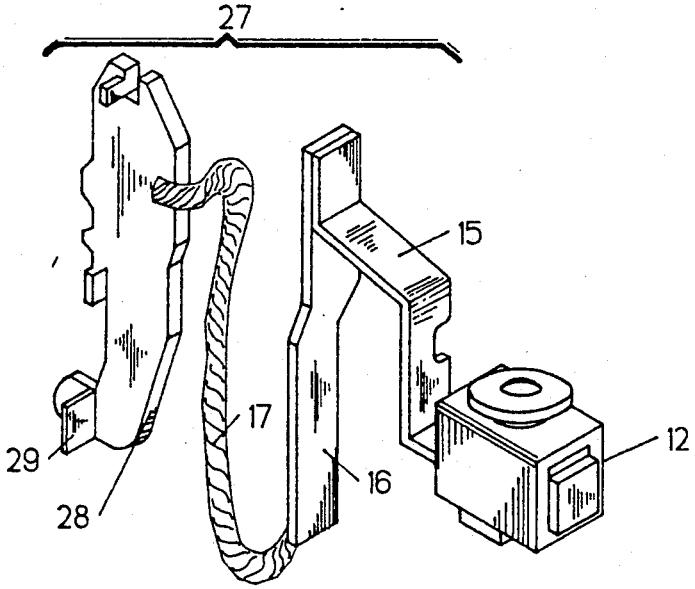
FIG. 3 is a front perspective view of the current path assembly within the thermal-magnetic trip unit of FIG. 1.
Figure 4:
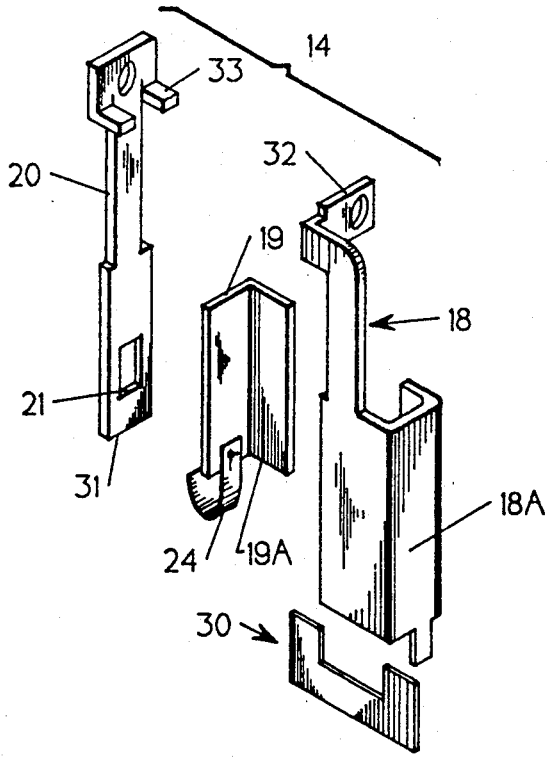
FIG. 4 is a front perspective view of the thermal-magnetic trip unit of FIG. 1 prior to assembly.

The assembly of the thermal-magnetic trip unit 14 of FIG. 1 is best seen by referring now to FIGS. 3 and 4 wherein the current path assembly 27 is depicted prior to assembly of the thermal-magnetic trip unit 14 around the bimetal 16. The load terminal lug 12 is attached to one end of the offset load strap 15 with the bimetal 16 welded or brazed to the opposite end thereof. As described earlier, the movable contact arm 28 which carries the movable contact 29 is assembled to the braid conductor 17 at one end and the bimetal 16 is attached to the other end thereof. The thermal-magnetic trip unit 14 is then assembled around the bimetal by first attaching the intermediate armature 19, made of a soft magnetic metal, to the latching element 20 by welding, brazing or mechanically attaching the opposite ends of the U-shaped spring 24 to the bottom ends of the intermediate armature 19 and the latching element 20. The latching element is formed from either a magnetic or non-magnetic material depending on the level of response desired and includes the rectangular latching slot 21 which receives the hook 22 shown earlier with reference to FIG. 1. The magnet 18 is formed from a durable magnetic metal and is shaped to form an offset sidepiece, as indicated at 18A, to provide a U-shaped structure surrounding the current carrying bimetal 16 and cooperates with the intermediate armature 19 which is shaped, as indicated at 19A, to form a "closed" magnetic circuit around the bimetal 16 when the thermal-magnetic trip unit 14 is assembled around the bimetal. The magnet 18 is attached to the latching element 20 by positioning the flat U-shaped stop 30 under the magnet such that one arm of the stop sits under the front edge of the bottom of the magnet and the other arm of the stop sits under the back edge of the bottom 31 of the latching element 20, as shown in FIG. 1. The offset top 32 of the magnet is supported on the tabs 33 extending from the top of the latching element 20.

Figure 3C:
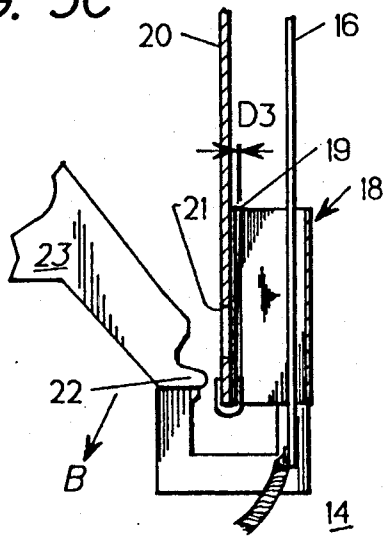
FIGS. 3A, 3B, and 3C are side views, in partial section of the thermal-magnetic trip unit of FIG. 1, depicting the displacement between the intermediate armature and the latching element during overcurrent conditions.
Figure 3B:
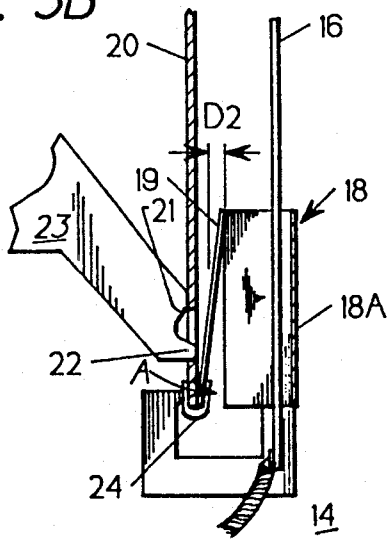
Figure 3A:
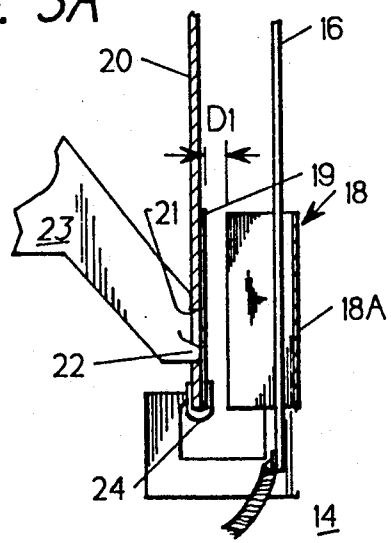

The assembled thermal-magnetic trip unit 14 is shown in FIGS. 3A-3C with part of the magnet removed to depict the positional relationship between the offset sidepiece 18A of the magnet, the bimetal 16, the intermediate armature 19 and the latching element 20. As described earlier, the rectangular latching slot 21 is formed in the latching element 20 to restrain the releasable element 23 until the latching element is displaced during predetermined overcurrent conditions. The U-shaped spring 24 is attached to the bottom ends of the latching element and the intermediate latch as described earlier. Under quiescent current operating conditions, that is, current that is within the circuit breaker ampere rating (I=X), the hook 22 at the end of the releasable element 23 is restrained within the latching slot 21 as indicated in FIG. 3A. The magnetic force exerted between the magnet 18 and the intermediate armature 19 is insufficient to overcome the tension of the U-shaped spring 24. The magnetic air gap between the forward edge of the magnet 18 and the adjacent edge of the intermediate armature 19 for quiescent current conditions is defined at $D_1$. In the arrangement depicted in FIG. 3B, circuit current through the bimetal 16 twice in excess of rated current (I=2X) overcomes the tension force exerted by the U-shaped spring 24 and draws the intermediate armature 19 slightly towards the magnet 18 as indicated at A producing a reduced magnetic air gap $D_2$. The hook 22 at the end of the releasable element 23 is still restrained within the slot 21 of latching element 20 and the U-shaped spring 24 is distorted to the extent indicated in FIG. 3B. As indicated in FIG. 3C, circuit current through the bimetal 16 three times in excess of rated current (I=3X) further reduces the magnetic air gap as shown at D3 which now causes the magnet 18, intermediate armature 19 and latching element 20 to move away from the releasable element 23 displacing the slot 21 from the hook 22 to allow the releasable element to rapidly rotate in the downward clockwise direction indicated by arrow B to articulate the circuit breaker operating mechanism and cause the contacts to become separated.

The relationship between the magnetic force and the magnetic air gap ($D_1$-$D_3$) between the magnet and the intermediate armature for the increasing current values I=X, I=2X, I=3X is best seen by referring back to FIG. 2 wherein the magnetic force across the magnetic air gap $D_1$ for a constant current I=X is shown at point 1, the magnetic force across the magnetic air gap $D_2$ is shown at point 2 and the magnetic force across the magnetic air gap $D_3$ is shown at point 3. The utilization of a U-shaped spring to resiliently attach the intermediate armature to the latching element automatically compensates for any manufacturing tolerances that occur between the individual components of the thermal-magnetic trip unit. The physical properties and the geometry of the spring are selected to automatically compensate for geometric variations of the other thermal-magnetic trip unit components.

Figure 5:
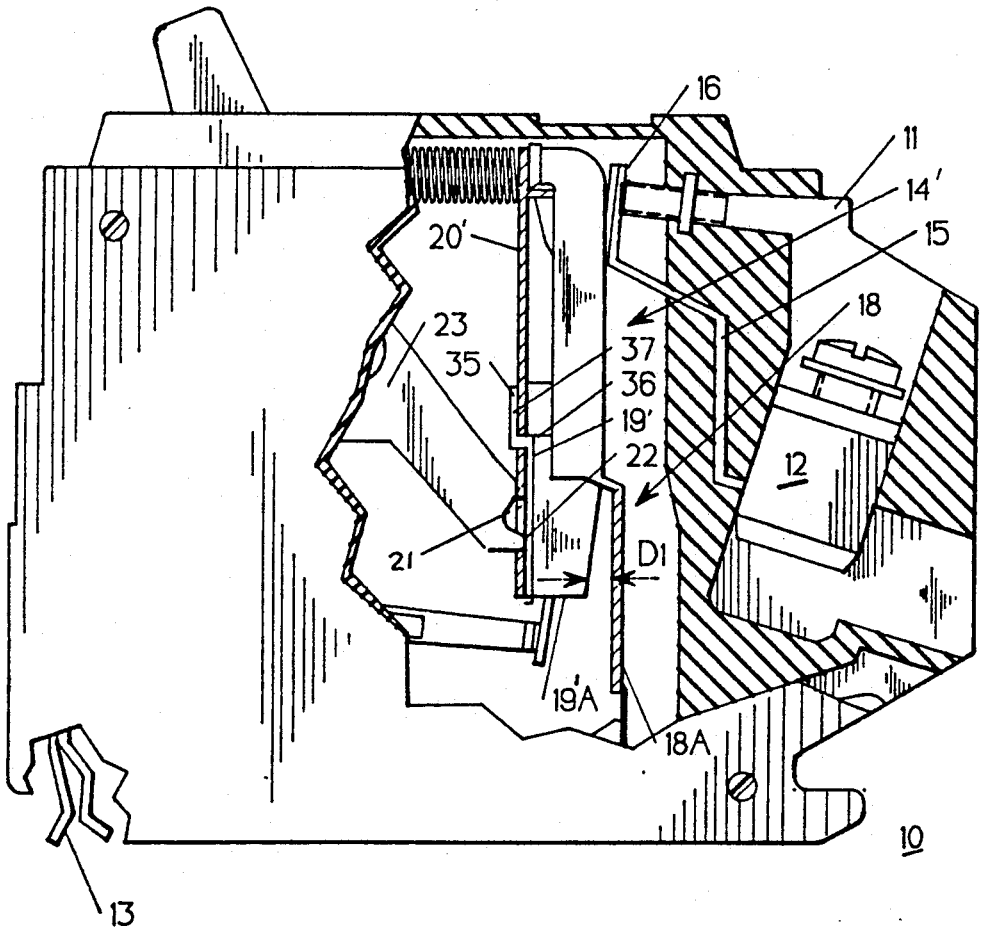
FIG. 5 is a front view of a residential circuit breaker with the cover partially removed to depict a thermal-magnetic trip unit according to a further embodiment of the invention.

The circuit breaker 10 depicted in FIG. 5 is similar to that described earlier with reference to FIG. 1 and similar reference numerals will be used where possible. Electrical connection with the external circuit is made by means of the load terminal lug 12 and load strap 13 which electrically connect with the bimetal 16, as indicated. The thermal-magnetic unit 14' differs from that described earlier by the arrangement of a force-multiplier intermediate armature, hereafter "force-multiplier armature" 19', that is arranged on the latching element 20' by insertion of the offset extension 35 formed on the top of the force-multiplier armature through the rectangular slot 36 formed within the latching element 20' above the slot 21 that retains the hook. The protrusion 37 extending from the offset extension 35 accurately positions the point of application of force by the force-multiplier 19' against the releasable element. The magnet 18 employs an offset sidepiece 18A that cooperates with the offset sidepiece 19' A on the force-multiplier armature 19' to form a magnetic circuit around the bimetal.

Figure 6:
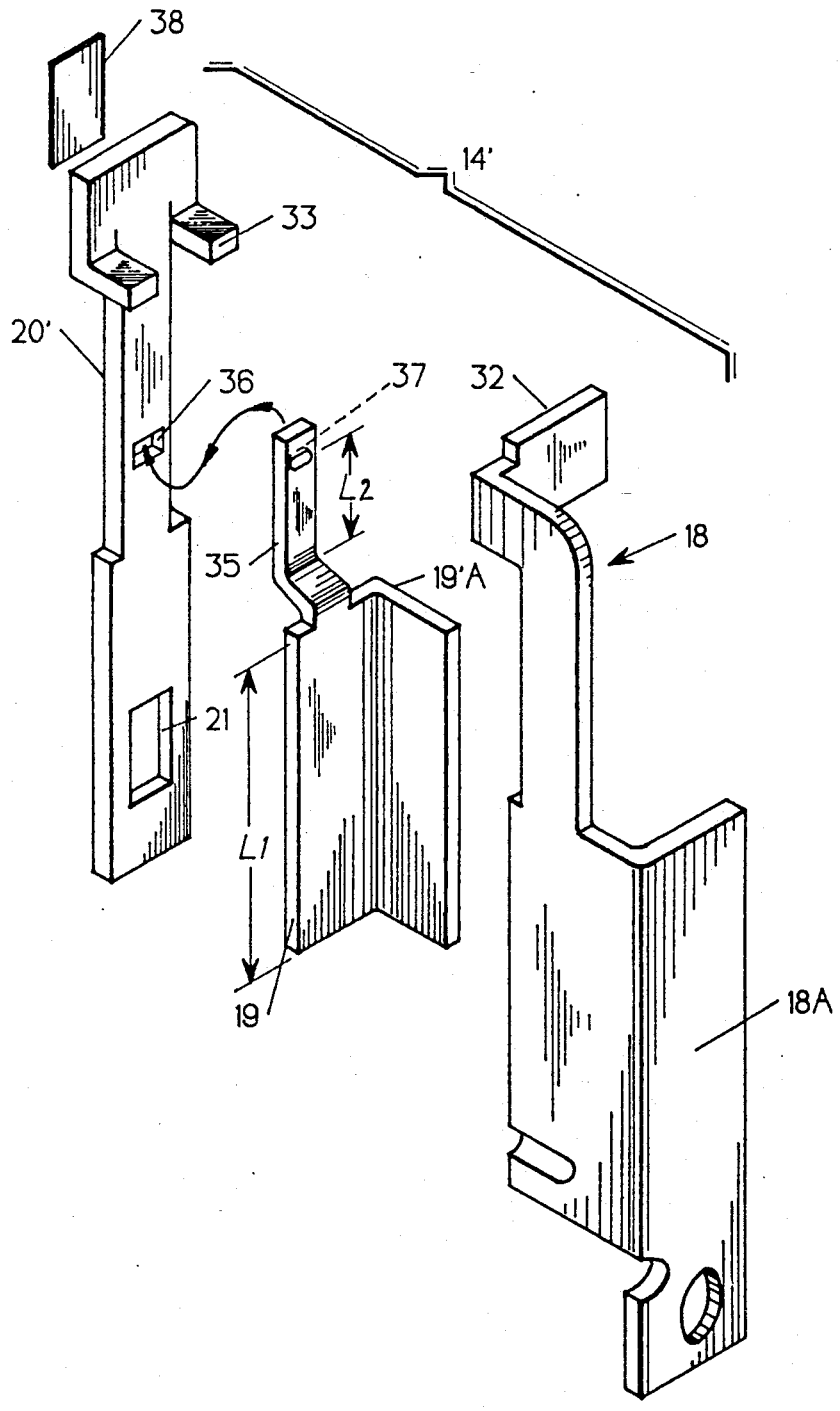
FIG. 6 is a front perspective view of the thermal-magnetic trip unit of FIG. 5 prior to assembly.
Figure 7C:
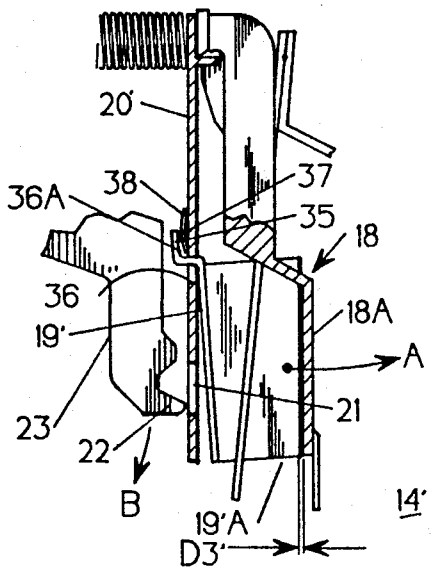
FIGS. 7A–7C are side views, in partial section of the thermal magnetic trip unit of FIG. 5 depicting the displacement between the intermediate armature and the latching element during overcurrent conditions.
Figure 7B:
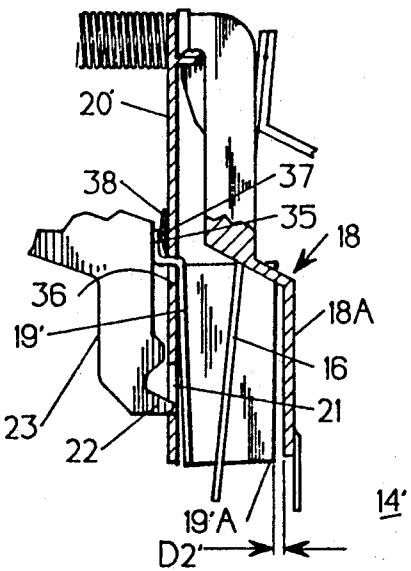
Figure 7A:
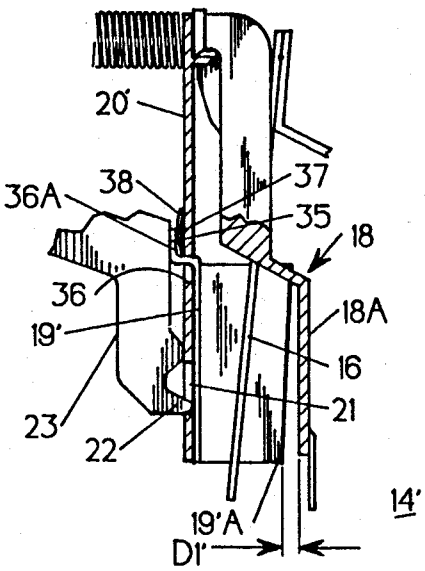

The assembly of the thermal-magnetic trip unit 14' is best seen by referring now to both FIGS. 5 and 6 wherein the force-multiplier armature 19' is depicted prior to insertion of the offset extension 35 within the rectangular slot 36 formed within the latching element 20', as indicated by the directional arrow. The latching element is similar to that described earlier and includes a slot 21 on the bottom thereof for receiving the hook 22 and includes a pair of tabs 33 which receive and support the offset tab 32 formed on the top part of the magnet 18. A planar spring 38 can be inserted between the offset extension 35 on the force multiplier armature and the top part of the latching element to bias the force-multiplier armature away from the latching element if so desired. The operation of the force-multiplier armature 19' is best seen by now referring to the thermal-magnetic trip units 14' depicted in FIGS. 7A–7C. The bimetal 16 extending within the magnet 18 and magnet sidepiece 18A is positioned at a fixed distance relative to the magnet and the force-multiplier armature 19'. The magnetic air gap between the edge of the magnet sidepiece 18A nd the edge of the force-multiplier armature sidepiece 19'A is depicted at $D_1'$ in FIG. 7A under quiescent current conditions. The hook 22 on the releasable element 23 is retained within the slot 21 and the projection 37 on the offset top part 35 of the force-multiplier armature 19' is held flat against the surface of the latching element 20' by the action of the spring 38 against the releasable element 23. The lever effect of the force-multiplier armature 19' is best seen by referring back to FIG. 6 where the ratio of the length $L_1$ of the bottom part 19 to the length $L_2$ of the top offset part 35 of the force-multiplier armature comprises the force multiplication factor of the lever arms $L_1$, $L_2$. The force-multiplier operates on the top edge 36A of the rectangular aperture 36 providing a fulcrum for operation of the top part 35 of the force-multiplier armature by means of the protrusion 37 formed on the force-multiplier armature extension 35. The occurrence of an overcurrent condition through the bimetal 16, induces a magnetic force of attraction between the magnetic sidepiece 18A and the edge of the force-multiplier armature sidepiece 19'A across the magnetic air gap $D_1'$. The corresponding displacement of the force-multiplier armature 19' in the direction of the magnet sidepiece 18A increases the magnetic force applied across the new magnetic air gap $D_2'$ as depicted in FIG. 7B. The increased magnetic force is reflected in a substantial increase in the displacement force lever action applied to the releasable element 23 by means of the protrusion 37 on the top part 35 of the force-multiplier armature 19'. Further increase in the magnetic force generated between the magnet 18 and the force-multiplier armature sidepiece 19'A substantially increases the force applied to the releasable element 23 and moves the force multiplier sidepiece 19'A toward the magnet sidepiece 18A and reduces the magnetic separation gap to $D_3'$ as shown in FIG. 7C. This in turn rotates the top part 35 of the force-multiplier armature 19' to the extent that the releasable element 23 moves away from the latching element 20' driving the hook 22 out of the slot 21. This allows the circuit breaker operating mechanism to become articulated and separate the circuit breaker contacts. Upon cessation of the overcurrent condition and the collapse of the magnetic force between the magnet 18 and the force-multiplier armature 19', the force-multiplier armature rotates back against the latching element 20' by return bias provided by the flat spring 38.

It is thus seen, that in addition to reducing the separation distance between the magnet and the latching element, by the of the force-multiplier armature in accordance with the relationship between the magnetic force and the magnetic air gap separation distance, the force-multiplier armature substantially improves the magnetic trip response by mechanically pushing against the releasable element while the force-multiplier armature is simultaneously pulling the latching element away from the releasable element hook. Consistent and low current magnetic response can accordingly be achieved by controlling the ratio of the lengths $L_1$ and $L_2$ of the force-multiplier armature to lengths LI an increase the mechanical displacement force.

Having thus described my invention, what I claim and desire to secure by Letters Patent is:

1. A thermal-magnetic trip unit for molded case circuit breakers comprising:

a thermally-responsive electrically-conductive element arranged within an insulative case for connection with a circuit breaker line or load strap;

a stationary magnetically-responsive element at least partially surrounding said electrically-conductive element arranged for providing a magnet force in proportion to current transfer through said electrically conductive element;

a movable magnetically-responsive latching element arranged a predetermined separation distance from said stationary magnetically-responsive element to define a first magnet gap, said movable latching element retaining a circuit breaker releasable element under quiescent current through said electrically-conductive element and releasing a circuit breaker releasable element under a first overload current through said electrically-conductive element; and a movable intermediate armature between said stationary magnetically-responsive element and said movable latching element, said intermediate armature thereby moving toward said stationary magnetically-responsive element reducing said magnetic gap and causing said latching element to release said circuit breaker releasable element under a second overload current lower than said first overload current.

2. The trip unit of claim 1 wherein said intermediate armature is flexibly attached to said latching element.

3. The trip unit of claim 1 wherein said latching elemetn is movably attached to the case.

4. The trip unit of claim 3 wherein said intermediate armature is attached to said latching element between said latching element and said magnetically-responsive element.

5. The trip unit of claim 1 wherein said intermediate armature is attached to said latching element by a U-shaped spring.

6. A low magnetic trip responsive circuit breaker comprising:

a circuit breaker operating mechanism within a circuit breaker enclosure arranged for automatic interruptino of circuit current upon occurrence of an overcurrent condition of predetermined magnitude and duration;

a releasable element attached to said operating mechanism restraining said operating mechanism under quiescent current and releasing said operating mechanism upon occurrence of said overcurrent condition;

a thermally-responsive electrically-conductive element arranged for connection with a circuit breaker line or load strap;

a stationary magnetically-responsive element at least partially surrounding said electrically-conductive element arranged for providing a magnet force in proportion to current transfer through said electrically conductive element;

a movable latching element arranged a predetermined separation distance from said magnetically-responsive element to define a first magnet gap, said latching element retaining said releasable element under quiescent current through said electrically-conductive element and releasing said releasable element under overload current through said electrically-conductive element; and a movable intermediate armature between said magnetically-responsive elemetn and said latching element, said intermediate armature thereby providing a second magnetic gap upon occurrence of said overload current, said second magnetic gap being lower than said first magnetic gap.

7. The circuit breaker of claim 6 wherein said intermediate armature is flexibly attached to said latching element.

8. The circuit breaker of claim 6 wherein said latching element is pivotally attached at a top part thereof.

9. The circuit breaker of claim 6 wherein said intermediate armature is attached to a bottom part of said latching element.

10. The circuit breaker of claim 6 wherein said intermediate armature is attached to said latching element by a U-shaped spring.

11. A thermal magnetic trip unit for circuit breakers comprising:

a thermally-responsive electrically-conductive element arranged for connection with a circuit breaker line or load strap;

a magnetically-responsive element at least partially surrounding said electrically-conductive element arranged for providing a magnet force in proportion to current transfer through said electrically conductive element;

a latching element movably arranged a predetermined separation distance from said magnetically-responsive element to define a magnet gap, said latching element arranged for retaining a circuit breaker releasable element under quiescent current through said electrically-conductive element and releasing a circuit breaker releasable element under overload current through said electrically-conductive element; and a force amplifier armature movably arranged on said latching element for contacting a circuit breaker releasable element and providing a displacement force against said circuit breaker releasable element in propotion to said current transfer through said electrically-conductive element.

12. The trip unit of claim 11 wherein said force amplifier armature comprises a metal strap having a top part and an elongated bottom part.

13. The trip unit of claim 12 wherein said latching element provides means for movably mounting the intermediate armature between the latching element and the magnetically responsive element.

14. The trip unit of claim 12 wherein a part of the intermediate armature interfaces with said magnetically responsive element to thereby reduce said magnetic gap.

15. The trip unit of claim 12 wherein s aid off-set top part extends through said second slot.

16. The trip unit of claim 14 wherein a part of said top part contacts a part of a circuit breaker releasable element.

17. The trip unit of claim 15 wherein said bottom part interfaces with said magnetically responsive element to thereby reduce said magnetic gap.

18. A low magnetic trip responsive circuit breaker omprising a circuit breaker operating mechanism within a circuit breaker enclosure arranged for automatic interruption of circuit current upon occurrence of an overcurrent condition of predetermined magnitude and duration;

a releasable element attached to said operating mechanism restraining said operating mechanism under quiescent current and releasing said operating mechanism upon occurrence of said overcurrent condition;

a thermal-magnetic trip unit within said enclosure comprising a magnetically-responsive element at least partially surrounding said electrically-conductive element arranged for providing a magnet force in proportion to current transfer through said electrically conductive element;

a latching element pivotally arranged a predetermined separation distance from said magnetically-responsive element to define a magnet gap, said latching element arranged for retaining a circuit breaker operating cradle under quiescent current through said electrically-conductive element and releasing a circuit breaker operating cradle under overload current through said electrically-conductive element; and a force amplifier armature mounted on said latching element and privotally arranged for contacting a circuit breaker operating cradle and providing a displacement force against said circuit breaker operating cradle in proportion to said current transfer through said electrically-conductive element.

19. The circuit breaker of claim 17 wherein said force amplifier armature comprises a metal strap having an off-set top part and an elongated bottom part.

20. The circuit breaker of claim 17 wherein said latching element includes a first slot retaining an end of a circuit breaker releasable element and a second slot retaining said force amplifier armature.

21. The circuit breaker of claim 17 wherein said off-set top part extends through said second slot.

22. The circuit breaker of claim 17 wherein a part of said top part contacts a part of a circuit breaker releasable element.

23. The circuit breaker of claim 17 wherein said bottom part interfaces with said magnetically responsive element to thereby reduce said magnetic gap.

* * * * *